US006116947A

United States Patent [19]

Takayasu

[11] Patent Number: 6,116,947

[45] Date of Patent: Sep. 12, 2000

[54] FLEXIBLE BOARD LOW PROFILE ELECTRICAL CONNECTOR

[75] Inventor: Ryuichi Takayasu, Tokyo, Japan

[73] Assignee: Hirose Electric Co., Ltd., Tokyo, Japan

[21] Appl. No.: 09/123,491

[22] Filed: Jul. 28, 1998

[30] Foreign Application Priority Data

Jul. 29, 1997 [JP] Japan ..... 9-216963

[51] Int. Cl.[7] ..... H01R 12/24

[52] U.S. Cl. ..... 439/495; 439/260

[58] Field of Search ..... 439/495, 260, 439/492, 77, 67, 259, 267, 266

[56] References Cited

U.S. PATENT DOCUMENTS

| | | | |
|---|---|---|---|
| 5,458,506 | 10/1995 | Yamaguchi et al. | 439/495 |
| 5,580,272 | 12/1996 | Yamaguchi et al. | 439/495 |
| 5,785,549 | 7/1998 | Takayasu | 439/495 |
| 5,842,883 | 12/1998 | Igarashi et al. | 439/495 |
| 5,904,586 | 5/1999 | Takayasu | 439/260 |
| 5,906,498 | 5/1999 | Nagafuji | 439/260 |

FOREIGN PATENT DOCUMENTS

| | | |
|---|---|---|
| 0696090 | 2/1996 | European Pat. Off. . |
| 0787996 | 12/1996 | European Pat. Off. . |
| 0773608 | 5/1997 | European Pat. Off. . |

*Primary Examiner*—Lincoln Donovan
*Assistant Examiner*—Michael C. Zarroli
*Attorney, Agent, or Firm*—Kanesaka & Takeuchi

[57] ABSTRACT

A contact element (2) has an arm portion (2A) present in the opening of a housing (1). A bearing portion (4) has concentric upper concave and lower convex bearing surfaces (4A) and (4B). A pressure member (6) has a receiving slot (8) for gradually receiving the bearing portion (4) as it is rotated toward the closed position. The receiving slot (8) has upper and lower inner surfaces (8A) and (8B) engaging the upper convex and lower straight bearing surfaces (4A) and (4B), respectively. The pressure portion (7) is positioned close to a line including the center of rotation and the end of the lower inner surface (8B).

5 Claims, 6 Drawing Sheets

FLEXIBLE BOARD LOW PROFILE ELECTRICAL CONNECTOR

BACKGROUND OF THE INVENTION

1. Filed of the Invention

The present invention relates to flexible board electrical connectors.

2. Description of the Related Art

Japanese patent application Kokai No. 7-142130 discloses a flexible board electrical connector. As FIGS. 4–6 show, this connector comprises a housing 51 having an upper opening and a plurality of contact elements 52 provided such that the spring contact portions 52A are arranged in the upper opening. The housing 51 has a pair of support sections 53 on opposite sides of the upper opening, and circular bearing portions (not shown) are provided in the support sections to support a pressure member 54 for rotation between a closed position close to the contact elements 52 and an open position apart from the closed position. The contact elements 52 are made by stamping a metal sheet so as to have a shaft portion 52B whose center is aligned with an axis of rotation including the bearing portions. Consequently, when such contact elements 52 are arranged in channels 51A of the housing 1, the shaft portions 52B form a comb-like shaft between the bearing portions. The pressure member 54 has a concave bearing surface 54A so that when the pressure member 54 is rotated, the bearing surface 54A slides on the shaft portions 52B of the contact elements 52.

The pressure member 54 has an angular pressure portion 54B which presses down a flexible board F against the spring contact portions 52A when the pressure member 54 is rotated to the closed position.

As FIG. 5 shows, the housing 51 has a support floor 51B for supporting the front end of the flexible board F at a position deeper into the housing and higher than the spring contact portion 52A. When the pressure member 54 is rotated to the closed position, the pressure portion 54B presses the flexible board F at a pinpoint between the support floor 51B and the spring contact portions 52A.

In use, the pressure member 54 is rotated upwardly to the open position as shown by broken line in FIG. 5, and a flexible board F is inserted into the opening such that its connection portion faces down. At this point, the flexible board F is supported at two points by the spring contact portions 52A and the support floor 51B. When the pressure member 54 is rotated to the closed position as shown in FIG. 7, the pressure portion 54B of the pressure member 54 presses down the flexible board F at a point between the spring contact portions 52A and the support floor portion 51B. Thus, the connection portion of the flexible board F is brought into contact with the spring contact portions 52A of the contact elements 52 under a predetermined pressure.

However, there is a demand for a connector having a small height on a circuit board. The conventional connector does not fully meet this requirement.

SUMMARY OF THE INVENTION

Accordingly, it is an object of the invention to provide a low-profile flexible board electrical connector.

According to the invention there is provided a flexible board electrical connector comprising a housing having an upper opening and a pair of support sections at opposite ends of the upper opening, at least one contact element provided in the housing and made by stamping a metal sheet so as to have a spring contact portion lying in the upper opening and a bearing portion having upper and lower bearing surfaces, a pressure member supported by the support sections for rotation between a closed position close to the contact element and an open position apart from the closed position, the pressure member having a pressure portion for pressing the flexible board against the contact element when the pressure member is rotated to the closed position and a shaft portion sliding on the bearing portion and a receiving slot for gradually receiving the bearing portion as the pressure member is rotated toward the closed position and having upper and lower inner surfaces engageable with the upper and lower bearing surfaces.

When the pressure member is at the open position, there is no pressure member present in a space between the shaft portion and the spring contact portion of a contact element. That is, the pressure member does not enter the space until it is rotated to a predetermined position. Thus, the height of the housing is reduced by that much.

DESCRIPTION OF THE PREFERRED EMBODIMENT

Figure 1:
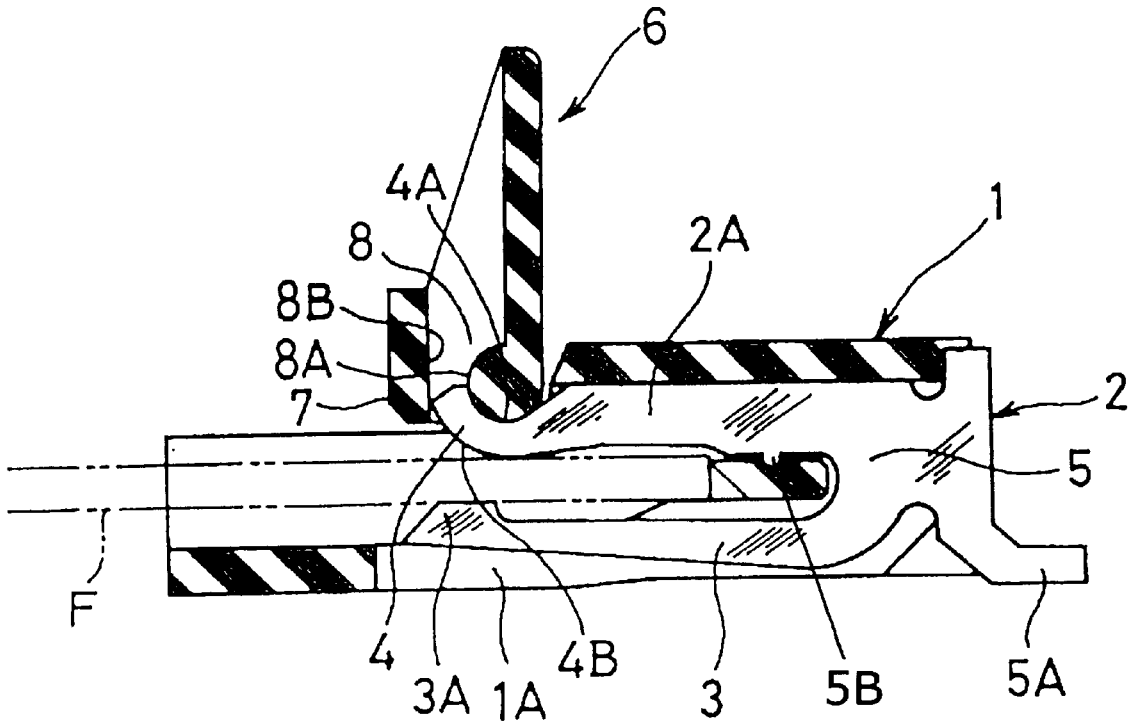
FIG. 1 is a sectional view of a connector according to the invention wherein the pressure member is at the open position.
Figure 4:
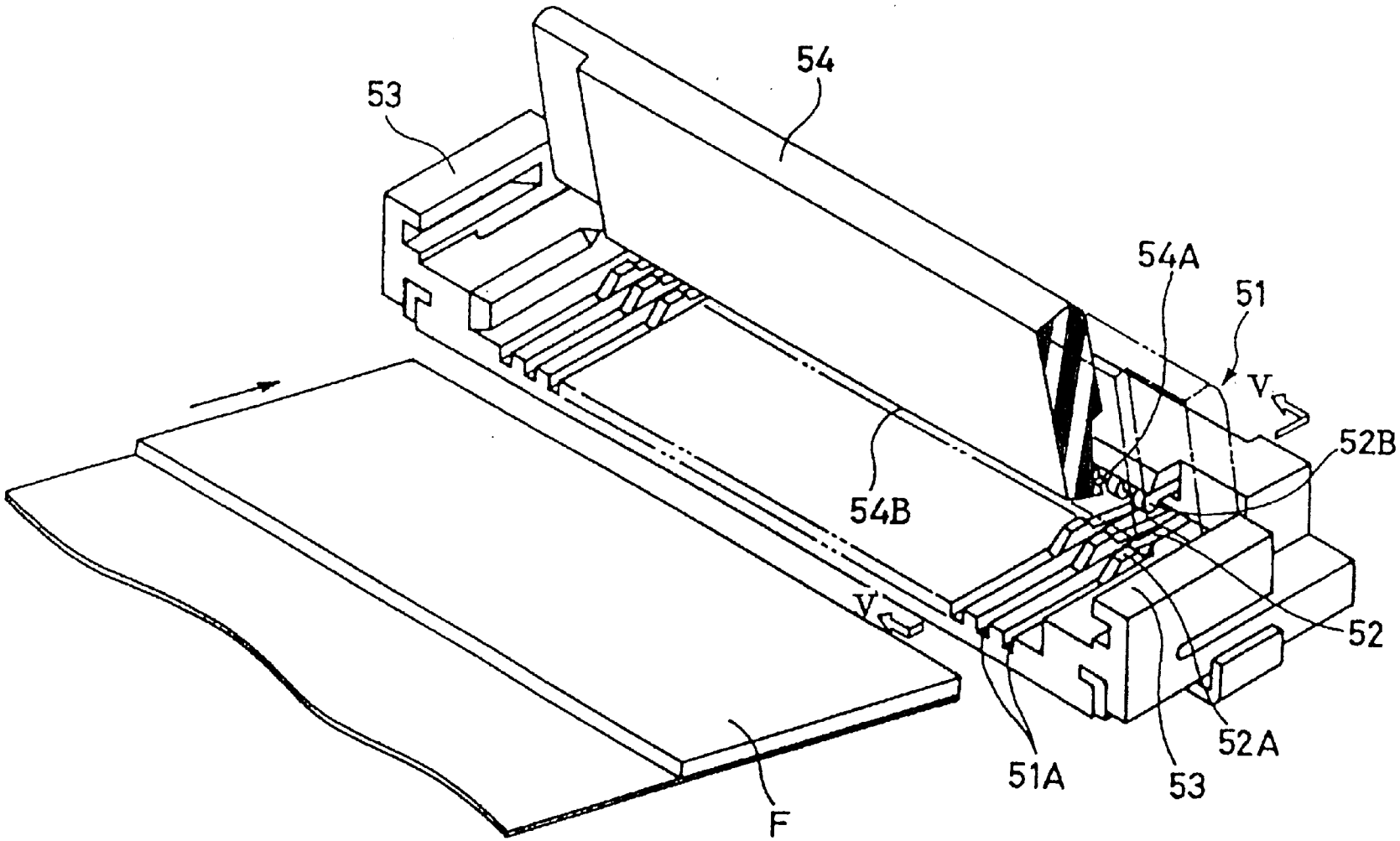
FIG. 4 PRIOR ART
FIG. 4 is a partially cutaway perspective view of a conventional connector.
Figure 5:
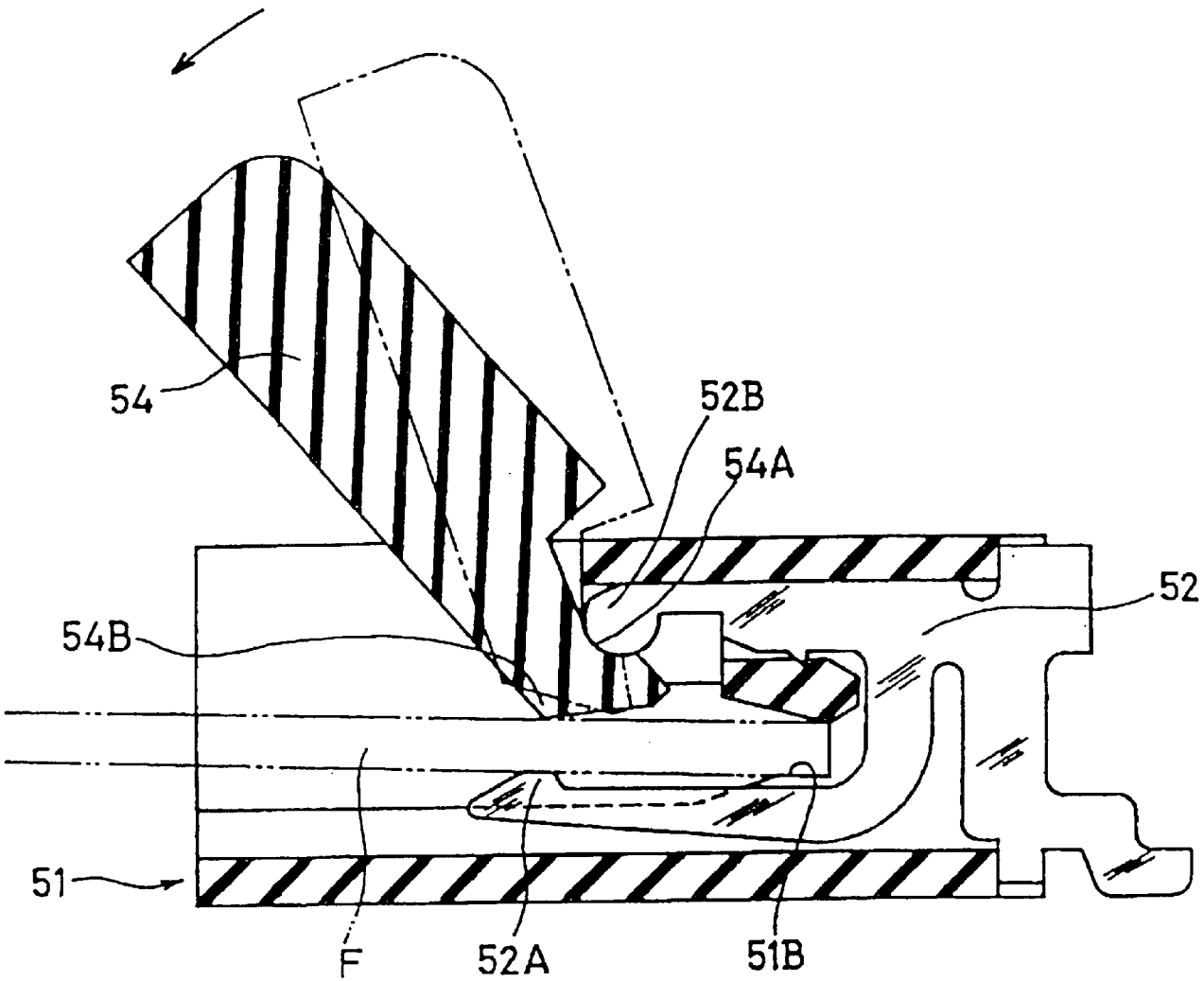
FIG. 5 PRIOR ART
FIG. 5 is a sectional view taken along line V—V of FIG. 4 wherein the pressure member is being rotated.
Figure 6:
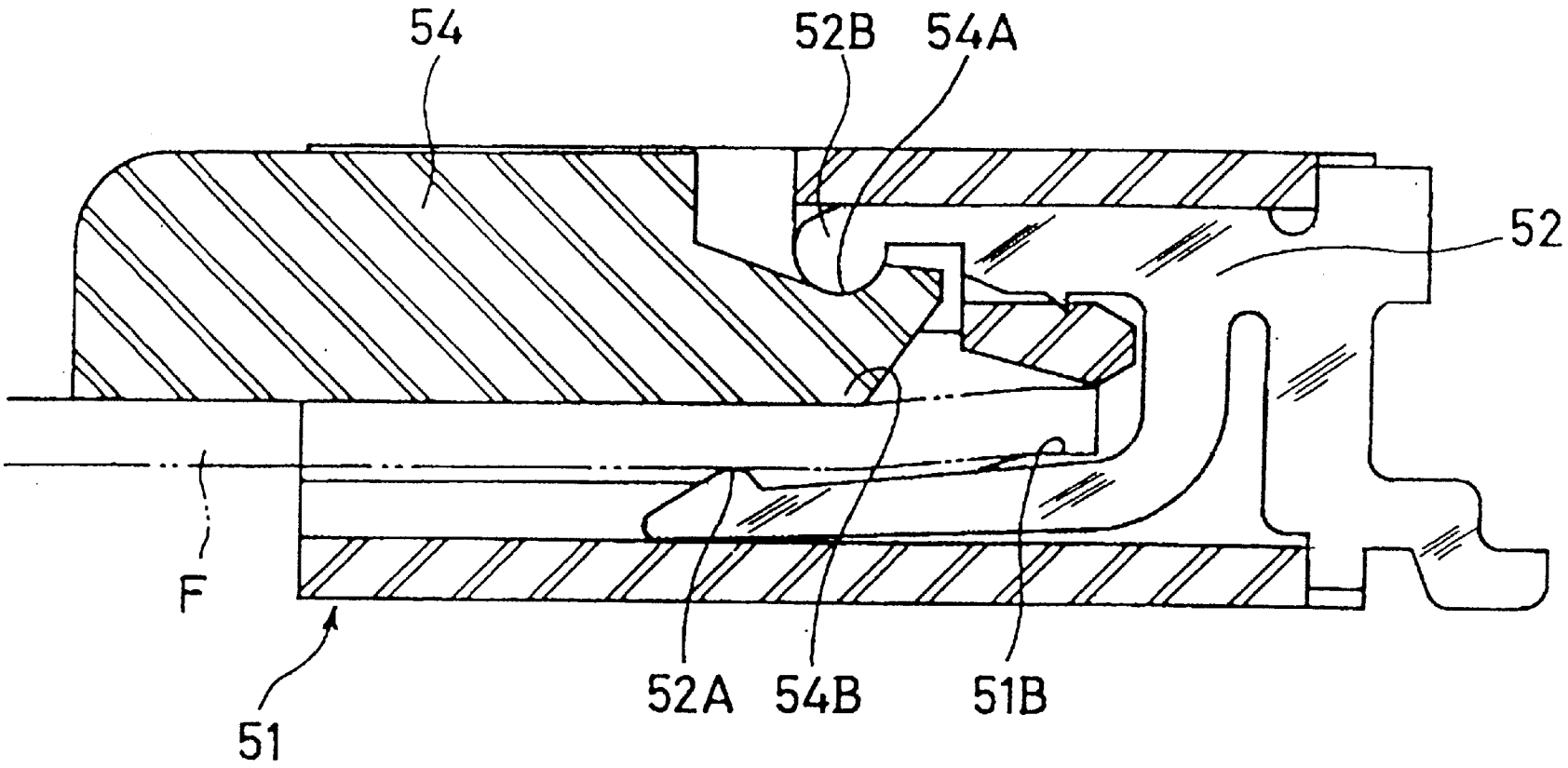
FIG. 6 PRIOR ART
FIG. 6 is a sectional view of the conventional connector wherein the pressure member is at the closed position.

In FIG. 1, a housing 1 is made of an insulating material so as to have an upper opening at the upper left corner. Like the conventional connector of FIG. 4, the housing 1 has a pair of support sections on opposite sides of the upper opening. A pair of bearing portions (not shown) having a circular surface are provided on the support sections. As in FIG. 4, a plurality of retaining channels 1A are provided at regular intervals between the support sections for holding contact elements 2. The retaining channels 1A are opened at the bottom.

The contact elements 2 are made by stamping a metal sheet so as to have a contact finger 3, an arm portion 2A having a semi-circular bearing portion 4 at the free end, and a link portion 5 for linking the contact finger 3 and the arm portion 2A. A connection portion 5A extends downwardly from the link portion 5 to a level substantially equal to the bottom of the housing 1. When the housing is mounted on a circuit board (not shown), the connection portion 5A contacts a trace of the electrical circuit for subsequent soldering. A spring contact portion 3A extends upwardly from a tip of the contact finger 3 so as to face the bearing portion 4.

The bearing portion 4 has an upper concave surface 4A and a lower convex surface 4B which are sections of concentric circles. The upper surface 4A opens toward above.

Such flat contact elements 2 are arranged in the length-wise direction which is perpendicular to the sheet.

The center of curvature of the bearing portion 4 or the upper concave and lower convex surfaces 4A and 4B is aligned with the center of the bearing portions of the housing 1. The contact elements 2 are press fitted into the retaining channels 1A from back (right side in FIG. 1) and held in place by projections 5B.

A pressure member 6 extending the lengthwise direction is provided at the upper opening of the housing 1 for rotation. It is made of an insulating material so as to have a pressure portion 7 and a pair of studs (not shown) extending outwardly from the opposite ends in the lengthwise direction so as to be supported by the semi-circular bearing portions of the housing 1.

A plurality of receiving slots 8 are provided in the pressure member 6 at positions corresponding to the bearing portions 4 of the contact members 2. Each slot 8 has an upper inner surface 8A and a lower inner surface 8B which is positioned beneath the upper inner surface 8A when the pressure member 6 is rotated to the closed position. The upper inner surface 8A has a convex shape fitting in the upper bearing surface 4A while the lower inner surface 8B is straight. The upper and lower inner surfaces 8A and 8B engage with the upper and lower bearing surfaces 4A and 4B, respectively.

The pressure portion 7 is positioned near a line including the center of rotation of the pressure member 6 and a point on the lower inner surface 8B so that when the pressure member 6 is opened, there is no pressure member 6 under the bearing portion 4 of the contact element 2.

A flexible board is connected to the electrical connector as follows:

(1) The pressure member 6 is rotated upwardly to the open position, and a flexible board F is inserted into a space between the spring contact portion 3A and the lower bearing surface 4B of the contact element 2 such that the connection portion of the flexible board F faces down.

Figure 2:
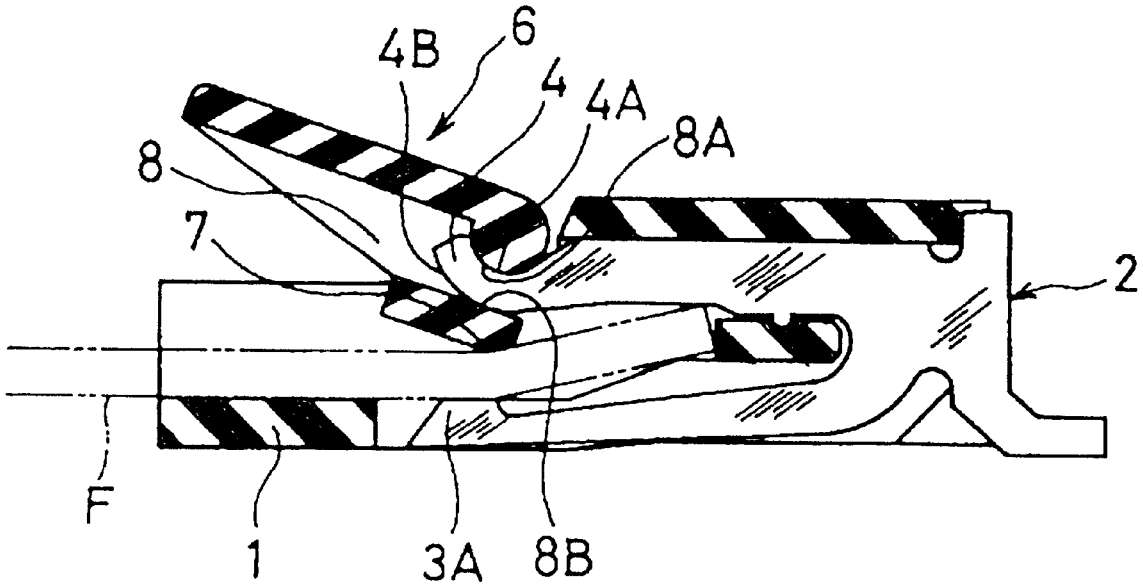
FIG. 2 is a sectional view of the connecter wherein the pressure member is being rotated.

(2) As FIG. 2 shows, the pressure member 6 is rotated downwardly so that the lower inner surface 8B of the pressure member slides on the lower bearing surface 4B to move into the housing 1. Consequently, the pressure portion 7 abuts against the flexible board F and presses down the spring contact portion 3A and the flexible board F supported by the housing 1. Thus, the flexible board F is resiliently bent and brought into contact with the contact portion 3A with a abutting pressure.

Figure 3:
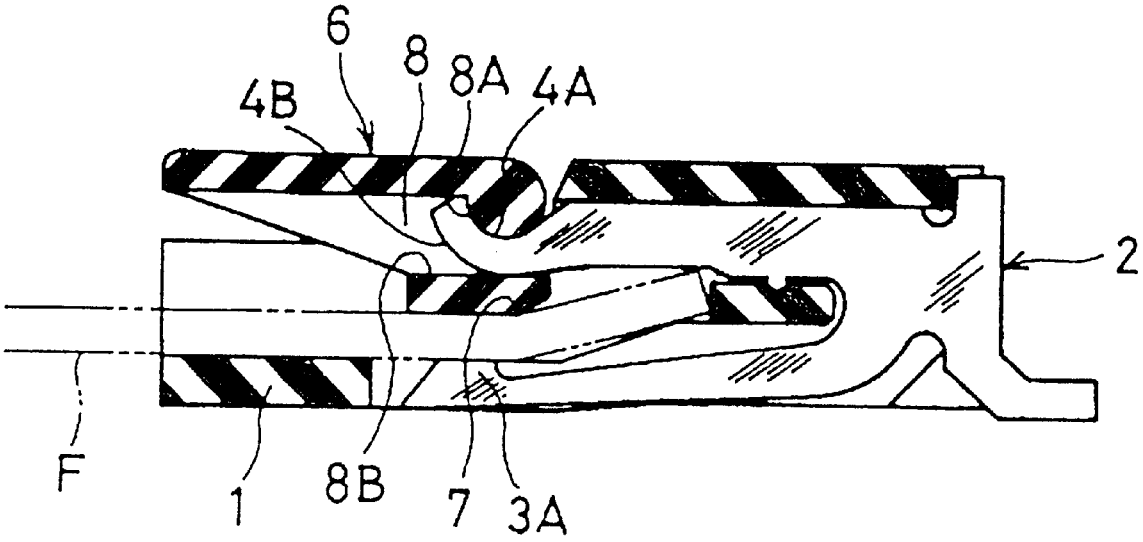
FIG. 3 is a sectional view of the connector wherein the pressure member is at the closed position.

(3) When the pressure member 6 is further rotated, the pressure portion 7 moves further into the housing 1 while the pressure on the flexible board is being decreased. Thus, the pressure member 6 is brought to the closed position as shown in FIG. 3.

The invention is not limited to the illustrated embodiment but may be modified. Especially, the bearing portion of a contact element and the pressure member may take a variety of shapes. For example, the upper concave surface of the bearing portion for guiding the upper inner surface may be made straight or convex. If the upper surface is convex, the lower surface should be concave. In addition, the lower inner surface of the pressure member may be made straight or concave.

When the pressure member is at the open position, no part of the pressure member is present in a space between the contact elements and the flexible board. When a pressure is applied, a portion of the pressure member enters the space to press down the flexible board so that the section is made thin, minimizing the height of the housing and the connector.

What is claimed is:

1. A flexible board low profile electrical connector comprising:

a housing made of an insulating material, at least one contact element provided in said housing and made by stamping a metal sheet so as to have a spring contact portion and a bering portion having upper and lower bearing surfaces, a pressure member supported by said housing for rotation around an upper end of said pressure member located above said bering portion between a closed position substantially parallel to said contact element and an open position substantially perpendicular to said closed position, said pressure member having a pressure portion for pressing said flexible board against said contact element when said pressure member is rotated to said closed position and a receiving slot for gradually receiving said bearing portion as said pressure member is rotated toward said closed position and having upper and lower inner surfaces engageable with said upper and lower bearing surfaces respectively.

2. A flexible board low profile electrical connector according to claim 1, wherein said upper bearing surface of said contact element is concave.

3. A flexible board low profile electrical connector according to claim 2, wherein said lower bearing surface of said contact element is convex corresponding to said upper bearing surface.

4. A flexible board low profile electrical connector according to claim 3, wherein said lower inner surface of said pressure member is straight.

5. A flexible board low profile electrical connector according to claim 3, wherein said lower inner surface of said pressure member is concave.

* * * * *